US006026275A

United States Patent [19]

Matsuzoe et al.

[11] Patent Number: 6,026,275

[45] Date of Patent: Feb. 15, 2000

[54] FIXING APPARATUS

[75] Inventors: Hisanobu Matsuzoe; Koji Migita; Yukinori Hara, all of Fukuoka, Japan

[73] Assignee: Matsushita Electric Industrial Co., Ltd., Osaka, Japan

[21] Appl. No.: 09/188,001

[22] Filed: Nov. 6, 1998

[30] Foreign Application Priority Data

Nov. 6, 1997 [JP] Japan ..... 9-304198

[51] Int. Cl.[7] ..... G03G 15/08

[52] U.S. Cl. ..... 399/335

[58] Field of Search ..... 399/335, 336, 399/337; 219/216

[56] References Cited

U.S. PATENT DOCUMENTS 4,768,057 8/1988 Kumada et al. ..... 399/336

FOREIGN PATENT DOCUMENTS 2-62444 5/1990 Japan .

*Primary Examiner*—Matthew S. Smith
*Assistant Examiner*—Greg Moldafsky
*Attorney, Agent, or Firm*—Ratner & Prestia

[57] ABSTRACT

A support member has a plurality of through-holes for supporting printing paper to which a fusible toner is adhered. Hot air is blown toward the printing paper. By releasing a considerable amount of hot air blown toward the support member downward through the through-holes, the amount of hot air bouncing on the surface of the support member is decreased. Thus, floating or fluttering of the leading end of the printing paper is prevented when the leading end of the printing paper rushes into the fixing apparatus.

14 Claims, 9 Drawing Sheets

FIXING APPARATUS

FIELD OF THE INVENTION

The present invention relates to a fixing apparatus for a hot air fixing system used in an image forming apparatus using a fusible recording material such as toner.

BACKGROUND OF THE INVENTION

As represented by the laser printer, recently, the performance of an image forming apparatus of electrophotographic system for forming sharp images excellent in resolution has been dramatically improved. To enhance the final printing quality of the image forming apparatus, a further improvement in the fixing process is desirable.

A fixing apparatus used in the fixing process in such an image forming apparatus is described below.

FIG. 8 is a schematic view showing a structure of a conventional fixing apparatus, and FIG. 9 is a plan view of a support member of the conventional fixing apparatus. FIG. 10 is a schematic view showing hot air blown by hot air means in the conventional fixing apparatus in a bounced state on the surface of the support member, FIG. 11 is a schematic view showing hot air blown by hot air means in the conventional fixing apparatus in a creeping state under printing paper, and FIG. 12 is a schematic view showing hot air blown by hot air means in the conventional fixing apparatus in a state pressing the leading end of printing paper.

As shown in FIG. 8, in the conventional fixing apparatus 1, the hot air fixing system is employed. In this hot air fixing system, printing paper 3 is an example of a recording medium and toner 2 is an example of a recording material. When paper 3 (with an image transferred thereon), is conveyed, hot air from hot air means 4 is blown to the printing paper 3 supported by a support member 5. The toner 2 on the surface of the printing paper 3 is then heated and fused, and fixed on the printing paper 3.

The hot air means 4 includes heat energy applying means 7 for generating heat energy, and blowing means 9 for blowing air to the heat energy applying means 7.

In the hot air means 4, the hot air generating procedure is described by referring to FIG. 8. An air stream generated in the blowing means 9 is blown to the heat energy applying means 7. The air stream is heated by direct heat of the heat energy applying means 7 to be hot air. The hot air fuses the toner 2 on the surface of the printing paper 3 to fix on the printing paper 3.

In the fixing apparatus 1, of a conventional hot air fixing system as shown in FIG. 9, the portion of the support member 5 for mounting the printing paper 3 on is flat. As shown in FIG. 10, the hot air blown onto the printing paper 3 from the hot air means 4 is bounced on the flat surface of the support member 5 supporting the printing paper 3 from its back side. Accordingly, when the leading end 10 of the printing paper 3 rushes into the hot air means 4, as shown in FIG. 11, as part of the hot air bouncing on the surface of the support member 5 creeps into the back side of the printing paper 3 from the leading end 10 of the printing paper 3, the leading end 10 of the printing paper 3 is lifted and floats. As a result, as shown in FIG. 12, the floating leading end 10 of the printing paper 3 is pushed to the support member 5 side by the hot air blown this time from above. Accordingly, when the motion in FIG. 11 and FIG. 12 is repeated, fluttering of the leading end 10 of the printing paper 3 occurs. It hence leads to disturbance of toner image or uneven fixing near the leading end 10 of the printing paper 3.

SUMMARY OF THE INVENTION

A fixing apparatus comprises a support member having a plurality of through-holes for supporting a recording medium to which a fusible printing material is adhered, and hot air means for blowing hot air to the recording medium disposed oppositely to the side of the support member for supporting the recording medium.

According to this constitution, a fixing apparatus solving the problems of floating or fluttering of leading end of printing paper at the time of rushing of the leading end of the printing paper into the fixing apparatus can be presented.

BRIEF DESCRIPTION OF THE DRAWINGS

FIG. 5(*b*) is a plan view showing the through-holes opened in the support member of the fixing apparatus in the exemplary embodiment of the invention.

DESCRIPTION OF THE PREFERRED EMBODIMENT

A preferred embodiment of the invention is described below.

In the fixing apparatus in the prior art, when the leading end of the printing paper rushes into the hot air means, the hot air blown from the hot air means is bounced on a flat support member on which the printing paper is mounted, and the leading end of the printing paper is caused to float or flutter. In an exemplary embodiment of the present invention, a plurality of through-holes are provided in the portion for mounting the printing paper, and a considerable amount of the hot air blown from the hot air means is allowed to escape downward from the through-holes in the support member, so that bouncing of hot air on the surface of the support member is decreased.

In addition, cold air means is provided at the upstream side of the hot air means so as not to damage the photosensitive material (and other materials) by the hot air generated in the hot air means flowing into the upstream side of the hot air means, and by forming an air curtain by the cold air generated by the cold air means, invasion of hot air into the upstream side of the hot air means is blocked.

The details of an exemplary embodiment of the invention is described below while referring to FIG. 1 to FIG. 6.

Figure 1:
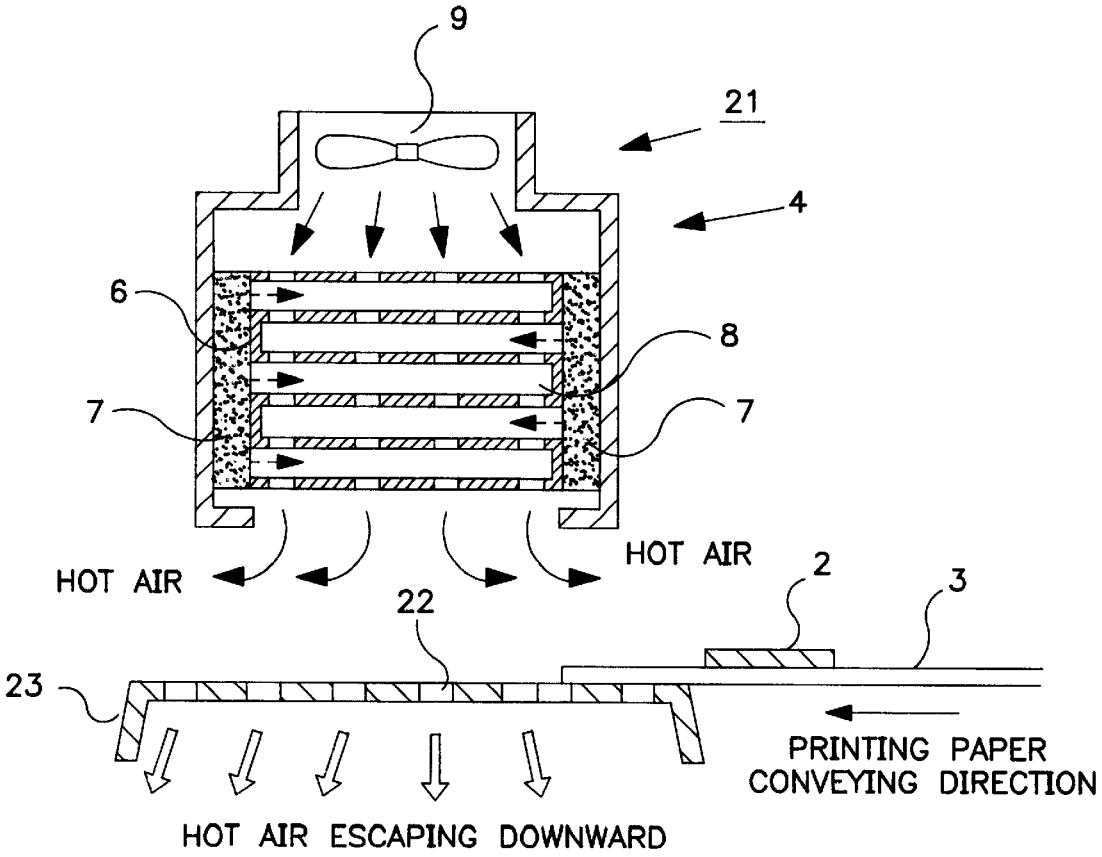
FIG. 1 is a schematic view showing a structure of a fixing apparatus in an exemplary embodiment of the invention.
Figure 2:
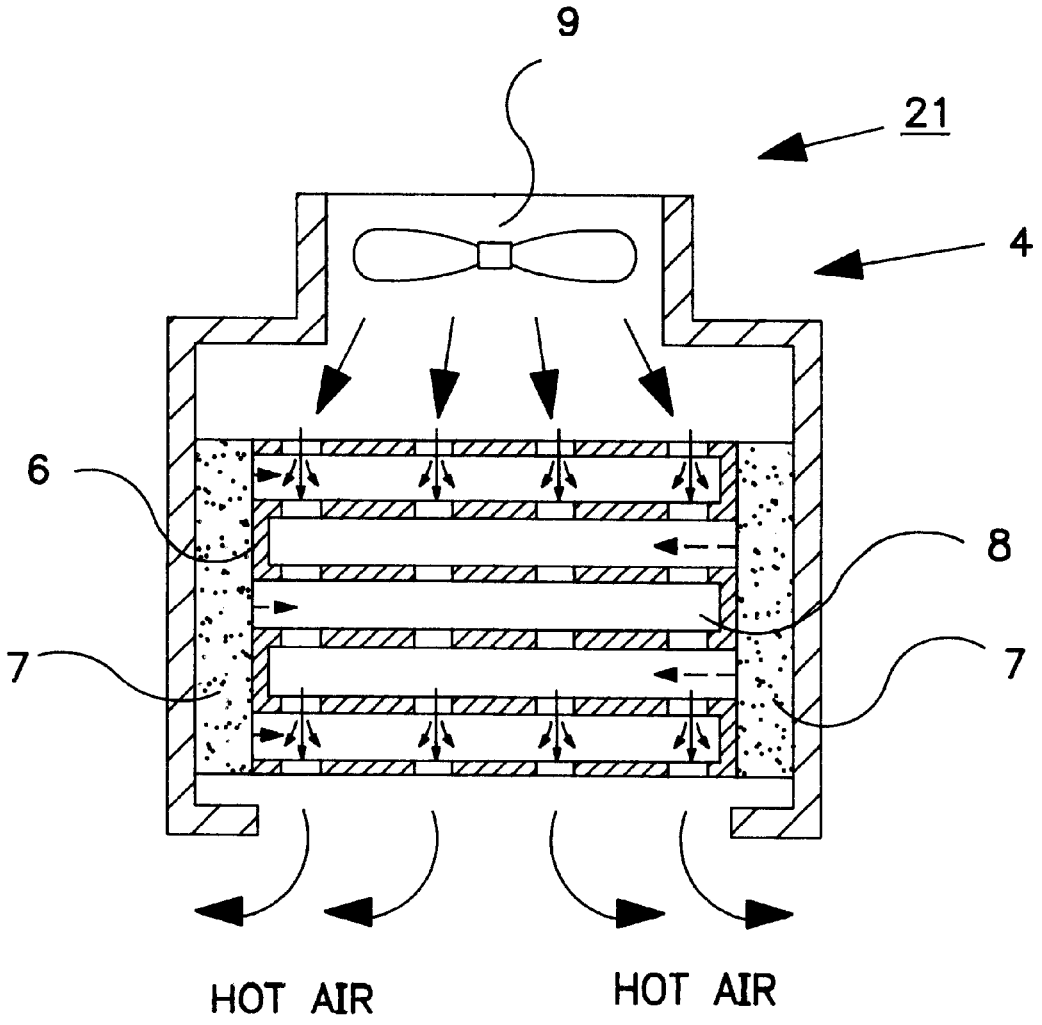
FIG. 2 is a schematic view showing the flow of an air stream flowing into a heating member of the fixing apparatus in the exemplary embodiment of the invention.
Figure 3:
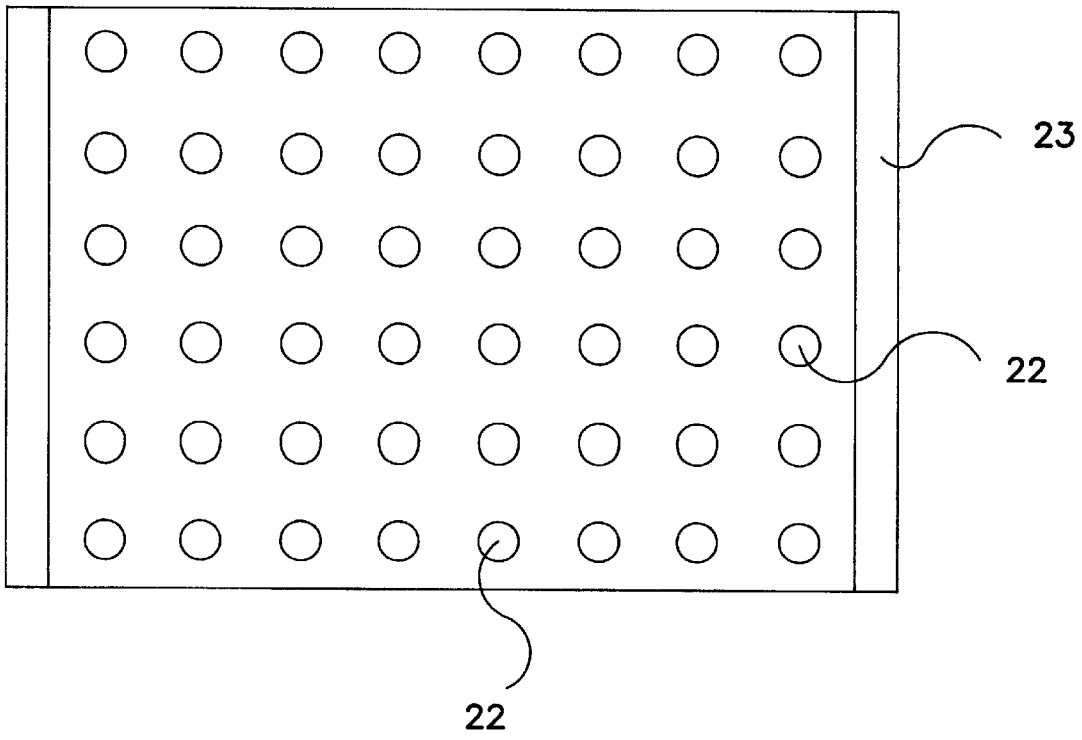
FIG. 3 is a plan view showing through-holes opened in the support member of the fixing apparatus in the exemplary embodiment of the invention.
Figure 4:
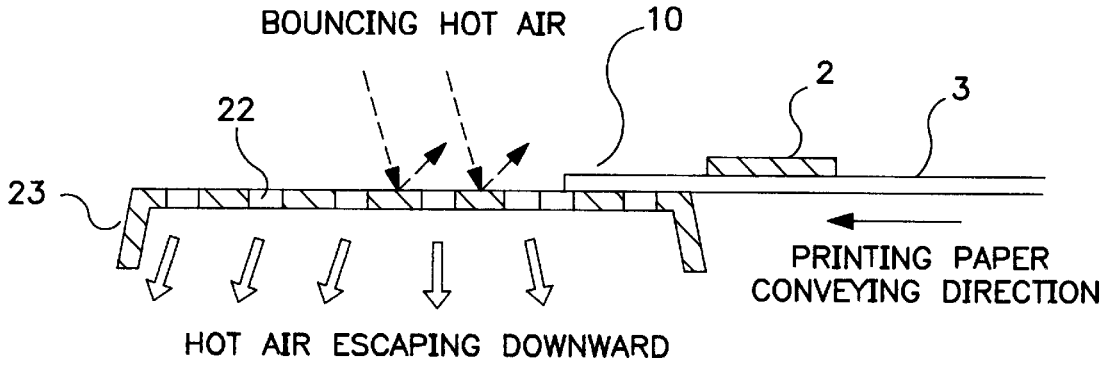
FIG. 4 is a schematic view showing the flow of a hot air blown to the recording medium by the hot air means of the fixing apparatus in the exemplary embodiment of the invention.
Figure 5:
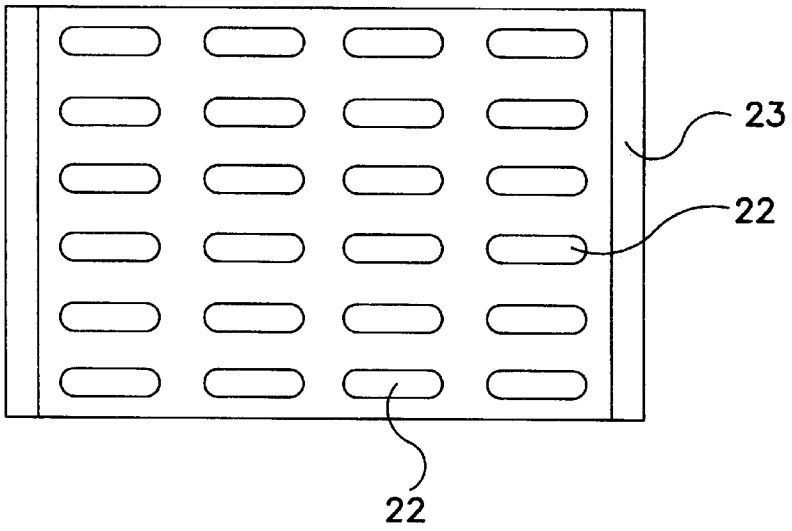
FIG. 5(*a*) is a plan view showing the through-holes opened in the support member of the fixing apparatus in the exemplary embodiment of the invention.
Figure 5:
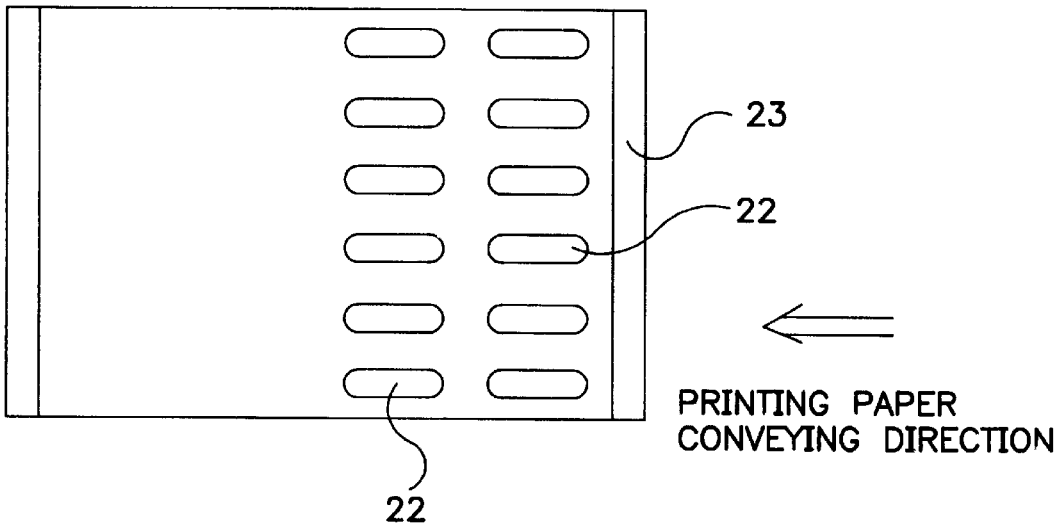
Figure 6:
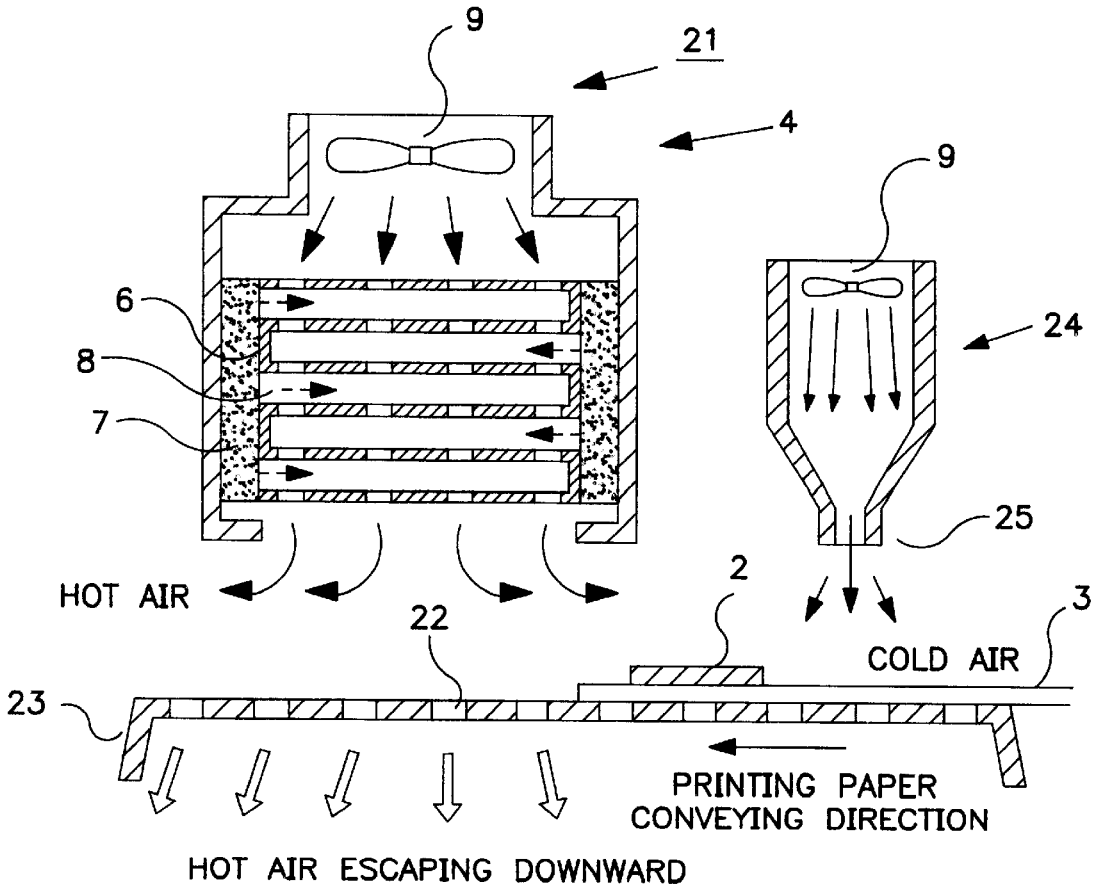
FIG. 6 is a schematic view showing the structure of cold air means of the fixing apparatus in the exemplary embodiment of the invention.
Figure 7:
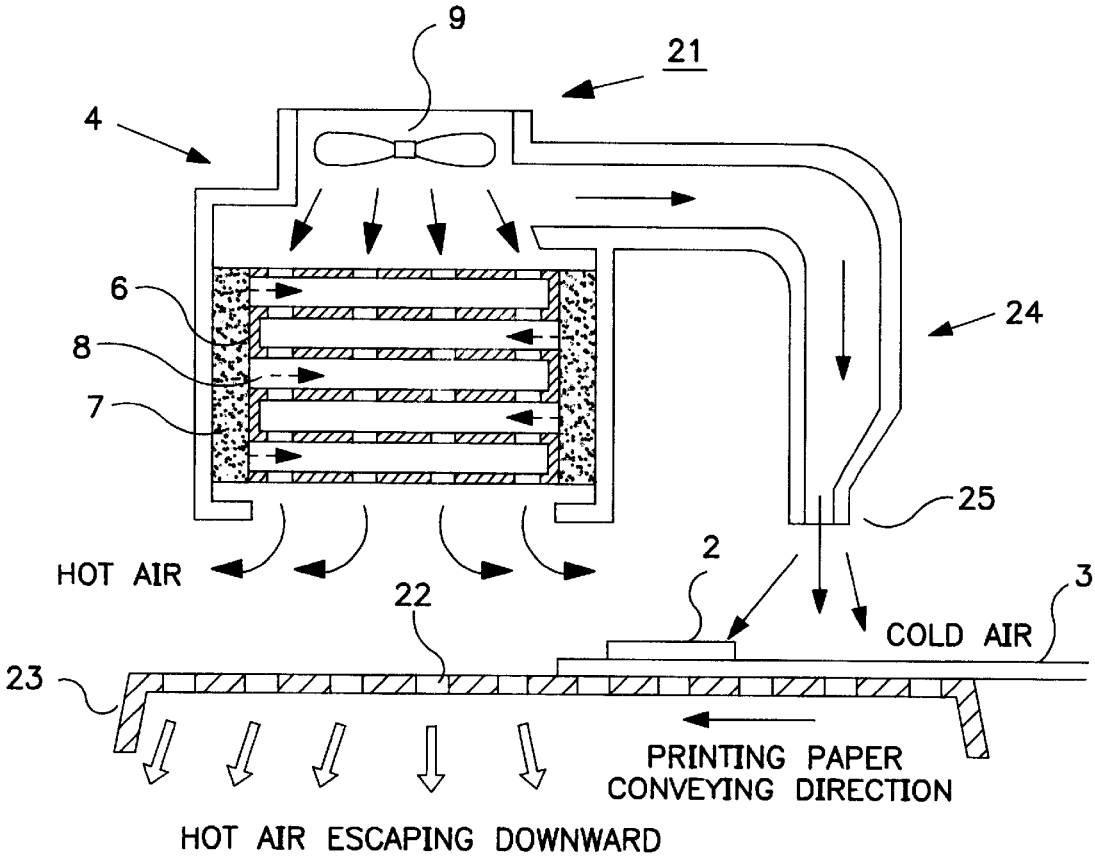
FIG. 7 is a schematic view showing the structure of cold air means of the fixing apparatus in the exemplary embodiment of the invention.
Figure 8:
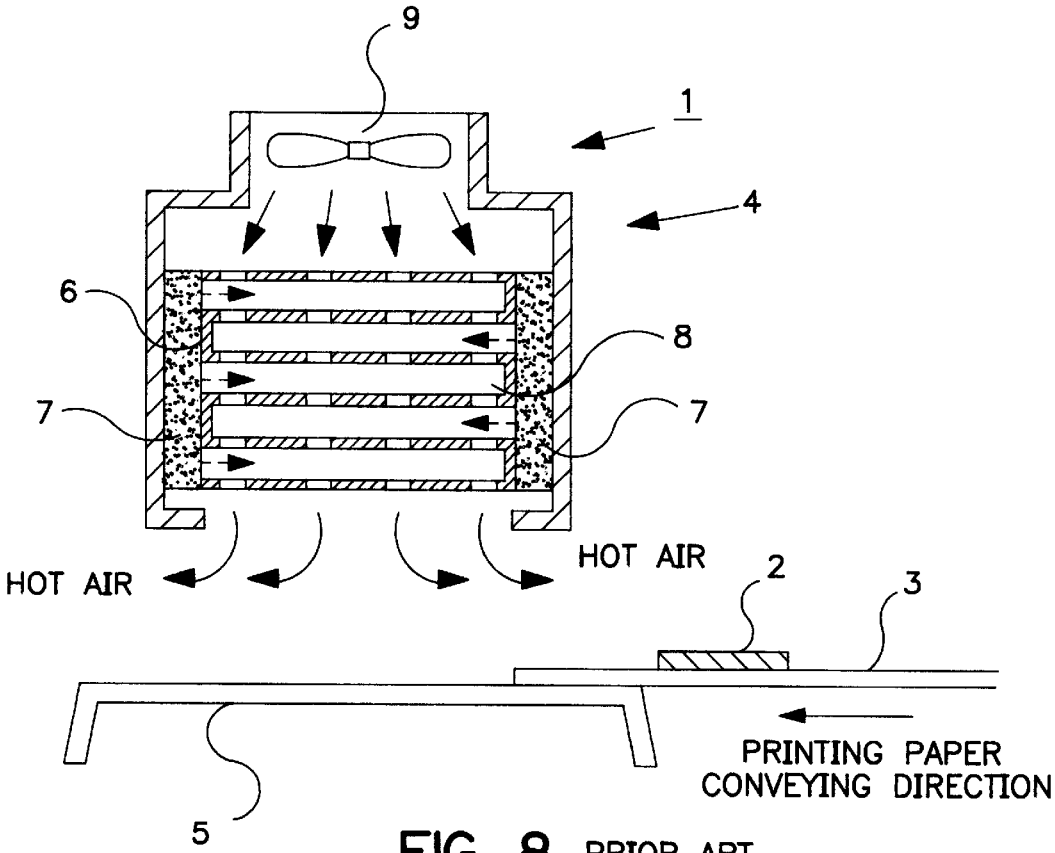
FIG. 8 PRIOR ART
FIG. 8 is a schematic view showing the structure of a conventional fixing apparatus.
Figure 9:
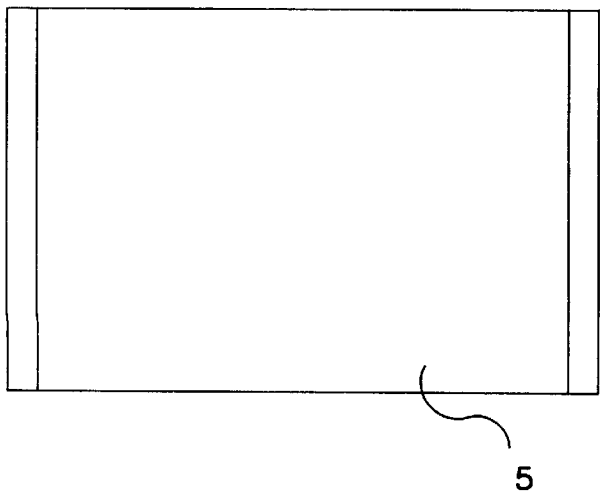
FIG. 9 PRIOR ART
FIG. 9 is a plan view of support member of the conventional fixing apparatus.
Figure 10:
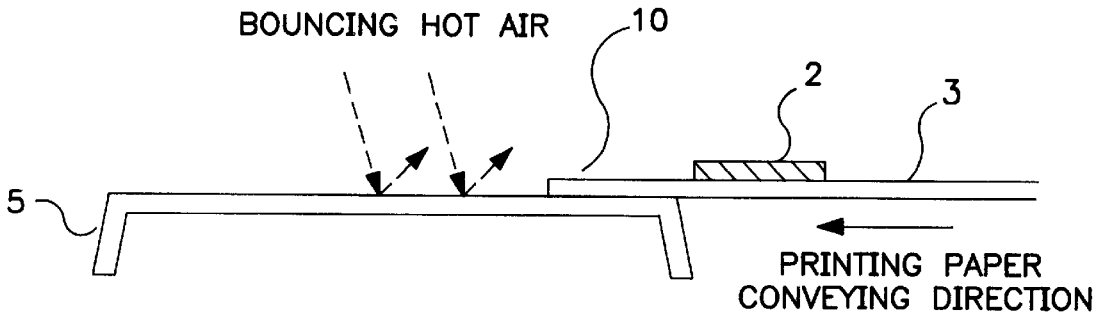
FIG. 10 PRIOR ART
FIG. 10 is a schematic view showing hot air blown by hot air means in the conventional fixing apparatus in a bounced state on the surface of the support member.
Figure 11:
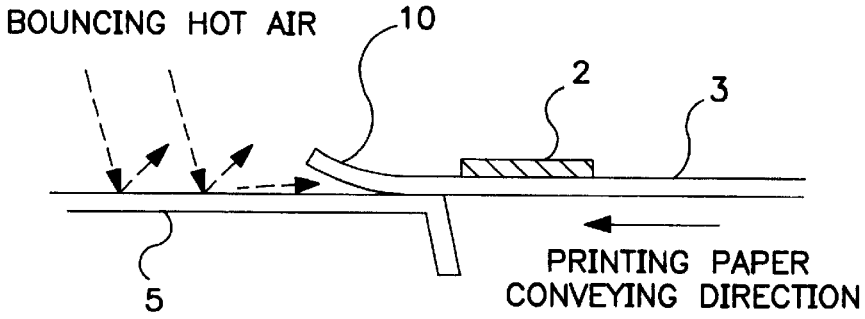
FIG. 11 PRIOR ART
FIG. 11 is a schematic view showing hot air blown by hot air means in the conventional fixing apparatus in a creeping state under printing paper.
Figure 12:
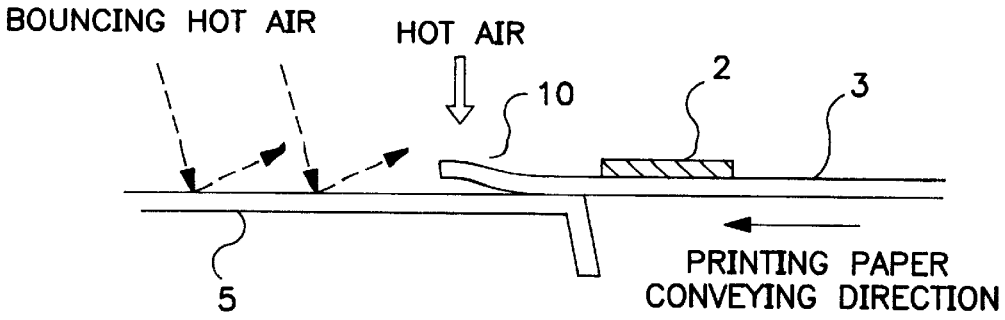
FIG. 12 PRIOR ART
FIG. 12 is a schematic view showing hot air blown by hot air means in the conventional fixing apparatus in a state pressing the leading end of printing paper.

FIG. 1 is a schematic view showing a structure of a fixing apparatus in an embodiment of the invention, and FIG. 2 is a schematic view showing the flow of an air stream flowing into a heating member of the fixing apparatus in the embodiment of the invention. FIG. 3 is a plan view showing through-holes opened in the support member of the fixing apparatus in the embodiment of the invention. FIG. 4 is a schematic view showing the flow of a hot air blown to the recording medium by the hot air means of the fixing apparatus in the embodiment of the invention. FIG. 5 is a plan view showing the through-holes opened in the support member of the fixing apparatus in the embodiment of the invention, and FIG. 6 and FIG. 7 are schematic views showing the structure of cold air means of the fixing apparatus in the embodiment of the invention.

As shown in FIG. 1, a fixing apparatus 21 employs the hot air fixing system. Printing paper 3 includes paper for Over Head Projector (OHP). Printing paper 3 is an example of recording medium on which an image is formed. Toner 2 is an example of a recording material. When printing paper 3 with an image formed by toner 2 is conveyed, hot air is blown from hot air means 4 to the printing paper 3 supported by a support member 23 having a plurality of through-holes 22 provided in the area for mounting the printing paper 3. The toner 2 on the surface of the printing paper 3 is heated and fused, and is fixed on the printing paper 3.

This hot air means 4 comprises a heating member 6, heat energy applying means 7 for applying heat energy to the heating member 6, and blowing means 9 for sending wind to through-holes 8 in the heating member 6.

The heating member 6 has a plurality of layers formed by folding a plate having a plurality of through-holes 8, and an air layer is enclosed between each air layer. The constitution of such heating member 6 is simple, and the manufacturing cost can be reduced. The heating means 6 receives heat as the heat is transmitted from the heat energy applying means 7. The heat energy applying means 7 is a ceramic heater because it is quick in rise (heating) and further smaller in thickness. The heating member 6 is an aluminum plate having an excellent heat conductivity. Of course, the heat energy applying means 7 may be made of other than a ceramic heater, and the heating member 6 may be also made of copper plate which has a better heat conductivity than the aluminum plate. In particular, when the ceramic heater is used, the hot air means 4 may be easily reduced in size. The blowing means 9 is a blower fan having an excellent blowing efficiency and a large air flow rate, and this blower fan is same as the type of the fan used in a dryer or the like.

The hot air generating procedure by the hot air means 4 is described below while referring to FIG. 1 and FIG. 2. The air stream formed in the blowing means 9 is blown to the heating member 6 heated by the heat transmitted from the heat energy applying means 7, and flows into the heating member 6 from the through-holes 8 in the highest layer. The air stream flowing in through the through-holes 8 in the highest layer diffuses as indicated by arrow in FIG. 2. The thus diffusing air stream contacts with the plate parts of the heating member 6, and flows into through-holes 8 of next layer while being heated by direct heat (indicated by broken line arrow) from the heat energy applying means 7 radiated from the gap portions of layers of the heating member 6 formed by folding one plate. Similarly, the air stream becomes hot air while absorbing heat from the heating member 6 in each layer. The air stream is blown out from the through-holes 8 in the lowest layer to fuse the toner 2 on the surface of the printing paper 3 to fix on the printing paper 3.

Incidentally, when the printing paper 3 is conveyed from the upstream side of the fixing apparatus 21 to the fixing apparatus 21 side, the leading end 10 of the printing paper 3 is exposed to the hot air blown from the hot air means 4, possibly causing to lift the leading end 10 of the printing paper 3 by the hot air bouncing on the surface of the support member 23.

However, as shown in FIG. 3, a plurality of through-holes 22 are provided in the support member 23. Accordingly, as shown in FIG. 4, a considerable amount of the hot air blown to the support member 23 escapes downward from the plurality of through-holes 22 provided in the portion of the support member 23 for mounting the printing paper 3. As a result, the amount of the hot air bouncing on the surface of the support member 23 is not large enough to lift the leading end 10 of the printing paper 3 being conveyed. Therefore, it does not cause floating or fluttering of the leading end 10 of the printing paper 3 as experienced in the prior art. Accordingly, disturbance or uneven fixing of toner image near the leading end 10 of the printing paper 3 does not occur, so that lowering of printing quality can be prevented in the fixing process.

Incidentally, the shape of the through-holes 22 provided in the support member 23 may be circular as shown in FIG. 3, or elliptical having both ends formed of curves as shown in FIG. 5(*a*). In short, the through-holes 22 are formed in a shape so that the hot air blown from the hot air means 4 may easily escape downward, and that the leading end 10 of the printing paper 3 may not be caught.

Moreover, as shown in FIG. 5(*b*), it is also possible to form through-holes 22 only at the upstream side in the conveying direction of the printing paper 3. In this case, too, floating or fluttering of the leading end 10 of the printing paper 3 can be prevented. Herein, while preventing floating or fluttering of the leading end 10 of the printing paper 3 at the upstream side in the conveying direction of the printing paper 3 forming the through-holes 22, it is also possible to fix stably also at the downstream side in the conveying direction not forming through-holes 22.

The size of the through-holes 22 may be appropriate for thermal fixing, and preferably about 1 square mm or more to 15 square mm or less.

If the size of the through-holes 22 is less than 1 square mm, the hot air blown from the hot air means 4 cannot escape easily downward. If the size of the through-holes 22 is larger than 15 square mm, the leading end 10 of the printing paper 3 is likely to get in and be caught in the through-holes 22 by the hot air.

The rate of the area of the through-holes 22 of the support member 23 may be appropriate, and preferably 20% or more to 50% or less.

If the rate of the area of the through-holes 22 of the support member 23 is less than 20%, the hot air blown from the hot air means 4 cannot escape easily downward. If the rate is more than 50%, the heat capacity of the support member 23 is not enough, and fixing may be defective.

As the fixing apparatus 21 of the hot air fixing system, rather than the fixing apparatus in which the printing paper 3 passes while moving continuously the fixing apparatus 21, it is most suited to the fixing apparatus in which the printing paper 3 passes while moving the fixing apparatus 21 intermittently.

Since the fixing temperature can be lowered by using hot air in fixing, uneven fixing is very low due to different fixing times for various parts of the printing paper 3 when the printing paper 3 passes the fixing apparatus 21 while moving intermittently.

In FIG. 1 through FIG. 5 described so far, the fixing apparatus 21 is composed of hot air means 4 and support member 23, but as shown in FIG. 6 and FIG. 7, the fixing means 21 may be composed of hot air means 4, support member 23, and cold air means 24.

The structure of the cold air means 24 is as shown in FIG. 6 and FIG. 7, and the cold air means 24 is provided at the upstream side of the hot air means 4 in both cases. In FIG. 6, by the blowing means 9 composed of blower fan and others, cold air (not heated, e.g. ordinary air) is generated, and blown from nozzle 25 to the printing paper 3 side to form an air curtain, so that the hot air blown out from the hot air means 4 is prevented from reaching to the upstream side of the cold air means 24. At the upstream side of the hot air means 4, a photosensitive material is provided when transferring the toner 2 on the printing paper 3, and when it is heated by hot air, deterioration of the photosensitive material is advanced to lower the picture quality. Besides, the toner 2 forming a sensible image on the photosensitive material may be also fused by the hot air, and when the fused toner deposits on the photosensitive material, the photosensitive material is desirably cleaned. Accordingly, in order to prevent the hot air generated in the hot air means 4 from reaching to the upstream side of the hot air means 4, the cold air means 24 is installed, and an air curtain is formed by the cold air formed in the cold air means 24, thereby shutting off hot air. In FIG. 7, the cold air means 24 and hot air means 4 are formed integrally. The air stream generated in the blowing means 9 is branched into the cold air means 24 side and hot air means 4 side, and cold air is blown out from the nozzle 25 to form an air curtain, and the hot air blown out from the hot air means 4 is shut off by the air curtain. In the cold air means 24 shown in FIG. 7, since the blowing means 9 is shared with the hot air means 4, it contributes to downsizing of the apparatus and saving of manufacturing cost.

As shown in FIG. 6 and FIG. 7, in the fixing apparatus 21 provided with the cold air means 24, the through-holes 22 provided in the support member 23 for mounting the printing paper 3 on are desirably distributed nearly to the cold air means 24. This is because, otherwise, the cold air blown to the support member 23 may cause to lift the leading end 10 of the printing paper 3 being conveyed also near the cold air means 24, same as in the case of the hot air means 4.

Meanwhile, the fixing apparatus of the present invention may be applied also to other image forming apparatus than of the electrophotographic system (toner system), and, for example, it may be applied to the image forming apparatus of a thermal transfer system using a thermal transfer film as a fusible recording material.

In the case of the image forming apparatus of the thermal transfer system, it is preferred to use a smooth printing paper owing to the characteristic of the transfer system. Today, however, plain paper such as copying paper is used generally, and there have been demands to overcome the problem of lowering of printing quality due to white spots when using plain paper of poor smoothness. Herein, "white spots" refers to a phenomenon occurring in printing paper of poor smoothness, that is, the ink staying on the convex area but not staying on the concave area, thereby appearing to be white around the concave area.

When such printing paper having such white spots is heated by the fixing apparatus of the invention, the ink staying on the convex area is fused to penetrate and spread over the printing paper, thereby covering the white spot area around the concave portions. As a result, the ink transfer surface of the printing paper after fixing is glossy and beautiful, and the final printing quality is improved notably.

Thus, an exemplary embodiment of the present invention includes a support member having a plurality of through-holes for supporting the recording medium on which a fusible recording material is applied, and hot air means for blowing hot air to the recording medium disposed oppositely to the face of the support member for supporting the recording medium. In this constitution, flow of hot air to the support member side of the recording means blown through the support member occurring when blowing hot air to the recording medium at the leading end of the recording medium can be eliminated, and the leading end of the recording medium is prevented from floating above the support member, thereby bringing about beneficial effects of preventing occurrence of paper jamming due to failure of conveyance of the recording medium as the recording medium floats from the support member to collide against the hot air means or the like.

In the case the recording material is a toner, moreover, disturbance of toner image due to contact of the toner at the leading end of the recording medium with the hot air means or the like can be prevented, so that the image of high picture quality is obtained advantageously.

Moreover, by disposing the blowing means for blowing air at a lower temperature than that of the hot air means to the recording medium at the upstream side in the conveying direction of the recording medium from the hot air means, it is possible to prevent deterioration by melting of toner and heat of photosensitive material in the toner deposition process by shutting of blowing of hot air into the toner deposition process to the recording medium of the toner by the wind from the blowing means, thereby bringing about advantageous effects of preventing lowering of picture quality due to fusion of toner and deterioration of photosensitive material or the like.

What is claimed is:

1. A fixing apparatus comprising:

a support member having a plurality of through-holes, said support member supporting a recording medium to which a fusible recording material is adhered, and hot air means for blowing hot air towards said recording medium, said hot air means fixing said fusible recording material, wherein said hot air passes through said plurality of through-holes to flow to a back side of said support member such that at least one of a floating and fluttering of a leading end of said recording medium is prevented.

2. A fixing apparatus of claim 1, wherein said recording material is a toner.

3. A fixing apparatus of claim 1, wherein each through-hole of said plurality of through-holes has a circular shape.

4. A fixing apparatus of claim 1, wherein each through-hole of said plurality of through-holes has an elliptical shape with curved ends.

5. A fixing apparatus of claim 1, wherein each through-hole of said plurality of through-holes has a shape with an area in a range from about 1 square mm to about 15 square mm.

6. A fixing apparatus of claim 1, wherein said plurality of through-holes occupy 20% to about 50% of a surface area of said support member.

7. A fixing apparatus of claim 1, wherein said recording medium passes intermittently on a surface of said support member.

8. A fixing apparatus of claim 1, wherein said plurality of through-holes are formed in said support member so that said hot air blown out from said hot air means may flow at a back side of said support member, and a leading end of said recording medium being conveyed through said hot air means does not rise relative to said support member.

9. A fixing apparatus of claim 1, wherein said hot air means includes a heat energy applying means for generating heat energy, a heating member for transmitting said heat energy generated from said heat energy applying means, and blowing means for blowing said heat energy to said recording medium.

10. A fixing apparatus of claim 1, wherein said hot air means includes a heat energy applying means for generating heat energy, a heating member for transmitting said heat energy generated s from said heat energy applying means, and blowing means for blowing said heat energy to said recording medium, said heating member has a plurality of layers, wherein each layer of said plurality of layers has a second through-hole, and wind generated by said blowing means passes through said second through-hole to be hot air, said hot air is blown to said recording medium, and said hot air blown to said recording medium passes through said plurality of through-holes to flow at the back side of said support member.

11. A fixing apparatus of claim 1, further comprising:

cold air means installed at an upstream side of said hot air means, in a conveying direction of said recording medium, said cold air means including cold air blowing means for blowing cold air of a lower temperature than said hot air of said hot air means, wherein said hot air means includes a heat energy applying means for generating heat energy, a heating member for transmitting said heat energy generated from said heat energy applying means, and hot air blowing means for blowing an air flow through said hot air means such that the air flow blown through said hot air means transfers said heat energy to said recording medium, and said cold air means directs an air flow generated by said cold air blowing means toward said recording medium.

12. A fixing apparatus comprising:

a support member having a plurality of through-holes, said support member supporting a recording medium to which a fusible recording material is adhered, hot air means for blowing hot air towards said recording medium, and cold air means situated at an upstream side of said hot air means, in a conveying direction of said recording medium, said cold air means blowing cold air of lower temperature than said hot air means toward said recording medium.

13. A fixing apparatus comprising, a support member having a plurality of through-holes, said support member supporting a recording medium to which a fusible recording material is adhered, and hot air means for blowing hot air towards said recording medium, wherein said plurality of through-holes are formed only in an upstream area of said support member in a conveying direction of said recording medium.

14. A fixing apparatus comprising:

a support member having a plurality of through-holes, said support member supporting a recording medium to which a fusible recording material is adhered, hot air means for blowing hot air towards said recording medium, and cold air means installed at an upstream side of said hot air means, in a conveying direction of said recording medium, wherein said hot air means includes a heat energy applying means for generating heat energy, a heating member for transmitting said heat energy generated from said heat energy applying means, and blowing means for blowing an air flow through said hot air means and said cold air means such that the air flow blown through said hot air means transfers said heat energy to said recording medium, and said cold air means directs an air flow generated by said blowing means toward said recording medium such that the air flow directed towards said recording medium is of a lower temperature than said hot air of said hot air means.

* * * * *